US012752902B2

(12) United States Patent
Okabe

(10) Patent No.: US 12,752,902 B2
(45) Date of Patent: Oct. 6, 2026

(54) OUTBOARD MOTOR

(71) Applicant: YAMAHA HATSUDOKI KABUSHIKI KAISHA, Iwata (JP)

(72) Inventor: Yoshihiko Okabe, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 422 days.

(21) Appl. No.: 18/383,045

(22) Filed: Oct. 24, 2023

(65) Prior Publication Data

US 2024/0208630 A1 Jun. 27, 2024

(30) Foreign Application Priority Data

Dec. 23, 2022 (JP) ..... 2022-206221

(51) Int. Cl.

| | |
|---|---|
| ***B63H 23/34*** | (2006.01) |
| ***B63H 20/00*** | (2006.01) |
| ***B63H 20/20*** | (2006.01) |
| ***B63H 20/32*** | (2006.01) |

(52) U.S. Cl.

CPC ..... *B63H 23/34* (2013.01); *B63H 20/002* (2013.01); *B63H 20/20* (2013.01); *B63H 20/32* (2013.01)

(58) Field of Classification Search

CPC ..... B63H 20/00; B63H 20/002; B63H 20/14; B63H 20/20; B63H 20/28; B63H 20/32; B63H 23/34; F04D 1/00; F04D 13/02; F01P 3/202; F01P 5/12; F01P 2050/04

USPC ..... 440/49, 75, 83, 88, 88 R, 88 C, 88 D, 440/88 G, 88 J, 88 K

See application file for complete search history.

(56) References Cited

U.S. PATENT DOCUMENTS

| | | | | |
|---|---|---|---|---|
| 4,016,825 | A | 4/1977 | Pichl | |
| 10,150,550 | B2 * | 12/2018 | Nakamura | B63H 23/30 |
| 10,295,046 | B2 * | 5/2019 | Hamada | B63H 20/20 |
| 10,427,771 | B2 | 10/2019 | Nakamura | |
| 10,507,897 | B2 * | 12/2019 | Nakamura | B63H 23/08 |
| 11,686,230 | B2 * | 6/2023 | Kuroda | B63H 20/28 60/321 |
| 11,702,970 | B2 * | 7/2023 | Harada | F02B 61/045 440/88 L |
| 12,049,291 | B2 * | 7/2024 | Nishimura | B63H 23/06 |
| 12,365,434 | B2 * | 7/2025 | Hikosaka | B63H 20/002 |
| 12,391,352 | B2 * | 8/2025 | Onoue | B63H 20/32 |

(Continued)

FOREIGN PATENT DOCUMENTS

JP 2015-145137 A 8/2015

OTHER PUBLICATIONS

Official Communication issued in corresponding European Patent Application No. 23202659.1, mailed on Mar. 27, 2024.

*Primary Examiner* — Daniel V Venne
(74) *Attorney, Agent, or Firm* — Keating & Bennett, LLP

(57) ABSTRACT

An outboard motor includes an electric motor, a drive shaft, a propeller, a propeller shaft, a cooling water flow path, a water pump including an impeller and a pump shaft, a first gear mechanism, and a second gear mechanism. The first gear mechanism includes a first gear to rotate together with the drive shaft and a second gear to mesh with the first gear and rotate together with the propeller shaft. The second gear mechanism includes a third gear, different from the first gear, to rotate together with the drive shaft, and a fourth gear to mesh with the third gear and rotate together with the pump shaft.

19 Claims, 5 Drawing Sheets

(56) References Cited

U.S. PATENT DOCUMENTS

| | | | | |
|---|---|---|---|---|
| 12,459,623 | B2 * | 11/2025 | Tanaka | F01P 3/202 |
| 2009/0203272 | A1 | 8/2009 | Okabe | |

* cited by examiner

OUTBOARD MOTOR

CROSS REFERENCE TO RELATED APPLICATIONS

This application claims the benefit of priority to Japanese Patent Application No. 2022-206221 filed on Dec. 23, 2022. The entire contents of this application are hereby incorporated herein by reference.

BACKGROUND OF THE INVENTION

1. Field of the Invention

The technologies disclosed herein relate to an outboard motor.

2. Description of the Related Art

Generally, outboard motors are equipped with a water pump to pump cooling water to cool the engine. The water pump includes an impeller or the like attached to a drive shaft. When the engine is driven, the impeller rotates together with the rotation of the drive shaft, and cooling water is pumped into the engine (see JP 2015-145137 A).

In the water pump of the above configuration, because the impeller is directly attached to the drive shaft, the rotational speed of the impeller depends on the rotational speed of the drive shaft. Therefore, it is difficult to adjust the rotational speed of the impeller according to the required amount of cooling water to be transported, which may hinder efficient cooling water transport.

SUMMARY OF THE INVENTION

An outboard motor according to a preferred embodiment of the present invention includes a drive unit, a drive shaft to be rotationally driven by the drive unit, a propeller, a propeller shaft to rotate together with the propeller, a cooling water flow path through which cooling water flows, a water pump including an impeller and a pump shaft to rotate together with the impeller to pump the cooling water into the cooling water flow path, a first gear mechanism to transmit rotation of the drive shaft to the propeller shaft, and a second gear mechanism to transmit rotation of the drive shaft to the pump shaft, wherein the first gear mechanism includes a first gear to rotate together with the drive shaft and a second gear to mesh with the first gear and rotate together with the propeller shaft, and the second gear mechanism includes a third gear, different from the first gear, to rotate together with the drive shaft, and a fourth gear to mesh with the third gear and rotate together with the pump shaft.

According to the above configuration, the second gear mechanism to transmit the rotation of the drive shaft to the pump shaft is provided separately from the first gear mechanism to transmit the rotation of the drive shaft to the propeller shaft. This configuration provides greater flexibility in setting the rotational speed of the impeller attached to the pump shaft for efficient cooling water transport, thus enabling efficient transport of the cooling water.

In the outboard motor, the drive shaft may be rotatable in both a forward direction and a reverse direction opposite to the forward direction, and the water pump may be a non-volumetric pump.

The drive shaft, which can rotate in both forward and reverse directions, eliminates the need for a clutch mechanism such as a dog clutch, thus providing a relatively large space around the propeller shaft. This space can be used to accommodate the water pump and gear mechanism, eliminating the need for a larger outboard motor and optimizing the arrangement of the components necessary to transport the cooling water. In addition, since the non-volumetric pump has no restriction on the direction of rotation, it is suitable as a pump connected to a drive shaft that is able to rotate in both the forward and reverse directions.

In the outboard motor, the drive unit may include an electric motor to be driven by electricity supplied from a power source.

In the outboard motor, the water pump may be a centrifugal pump.

In the outboard motor, the first gear mechanism and the second gear mechanism may have different gear ratios.

Such a configuration makes it easier to set the gear ratio of the first gear mechanism to an appropriate gear ratio to propel the boat and to set the gear ratio of the second gear mechanism to an appropriate gear ratio to transport the cooling water.

In the outboard motor, the first gear may be located closer to the drive unit than the third gear.

Since the first gear is used to turn the propeller to propel the boat, the force applied thereto is greater than the force applied to the third gear, which drives the water pump. Locating the first gear relatively close to the drive unit stabilizes the transmission of rotation through the first gear mechanism.

In the outboard motor, the drive shaft may include a main shaft and an extension shaft extending from the tip of the main shaft opposite to the drive unit and having a smaller outer diameter than the main shaft, wherein the first gear may be located on the main shaft and the third gear may be located on the extension shaft.

Since the third gear is used to drive the water pump, the force applied thereto is smaller than that of the first gear, which is used to rotate the propeller to propel the boat. By locating the third gear on the extension shaft, which is narrower than the main shaft where the first gear is located, the third gear and its surrounding configuration is more compact, and the outboard motor is prevented from becoming larger.

In the outboard motor, the water pump may be located on a rotation axis of the propeller shaft.

This configuration allows the water pump to be positioned without protruding sideways, thus avoiding a reduction in the propulsive force of the hull.

In the outboard motor, the cooling water flow path may include an intake port to take in cooling water from the outside, and a portion of the cooling water flow path from the intake port to the water pump may be located in front of the water pump and extend along a rotation axis line of the pump shaft.

In this configuration, cooling water drawn in from outside the outboard motor flows from the front to the impeller attached to the pump shaft allowing the cooling water to be pumped efficiently.

The outboard motor may include a partition wall to divide the gear chamber and the pump chamber and includes a shaft hole through which the pump shaft is inserted, and a plurality of seals may be provided inside the shaft hole on the outer surface of the pump shaft to fill a gap between an inner surface of the shaft hole and the pump shaft in line along a rotation axis of the pump shaft.

When a shaft hole through which the pump shaft is inserted is located in the partition wall dividing the gear chamber and the pump chamber as described above, it is important to prevent water from entering the gear chamber from the pump chamber through the shaft hole. By arranging a plurality of seals in line along the rotation axis of the pump shaft, it is possible to reliably prevent water from entering the gear chamber.

An outboard motor according to another preferred embodiment of the present invention includes a drive unit, a drive shaft to be rotationally driven by the drive unit, a propeller, a propeller shaft to rotate together with the propeller, a cooling water flow path through which cooling water flows, a water pump including an impeller and a pump shaft to rotate together with the impeller to pump the cooling water into the cooling water flow path, a first gear mechanism to transmit rotation of the drive shaft to the propeller shaft, and a second gear mechanism to transmit rotation of the drive shaft to the pump shaft.

According to the above configuration, the second gear mechanism to transmit the rotation of the drive shaft to the pump shaft is provided separately from the first gear mechanism to transmit the rotation of the drive shaft to the propeller shaft. This configuration provides greater flexibility in setting the rotational speed of the impeller attached to the pump shaft for efficient cooling water transport, thus enabling efficient transport of the cooling water.

Preferred embodiments of the present invention disclosed herein are able to efficiently transport cooling water.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Specific preferred embodiments of the technologies disclosed by this specification are described below with reference to the drawings. The present invention is not limited to these preferred embodiments but is indicated by the claims, which are intended to include all modifications within the meaning and scope equivalent to the claims.

Figure 1:
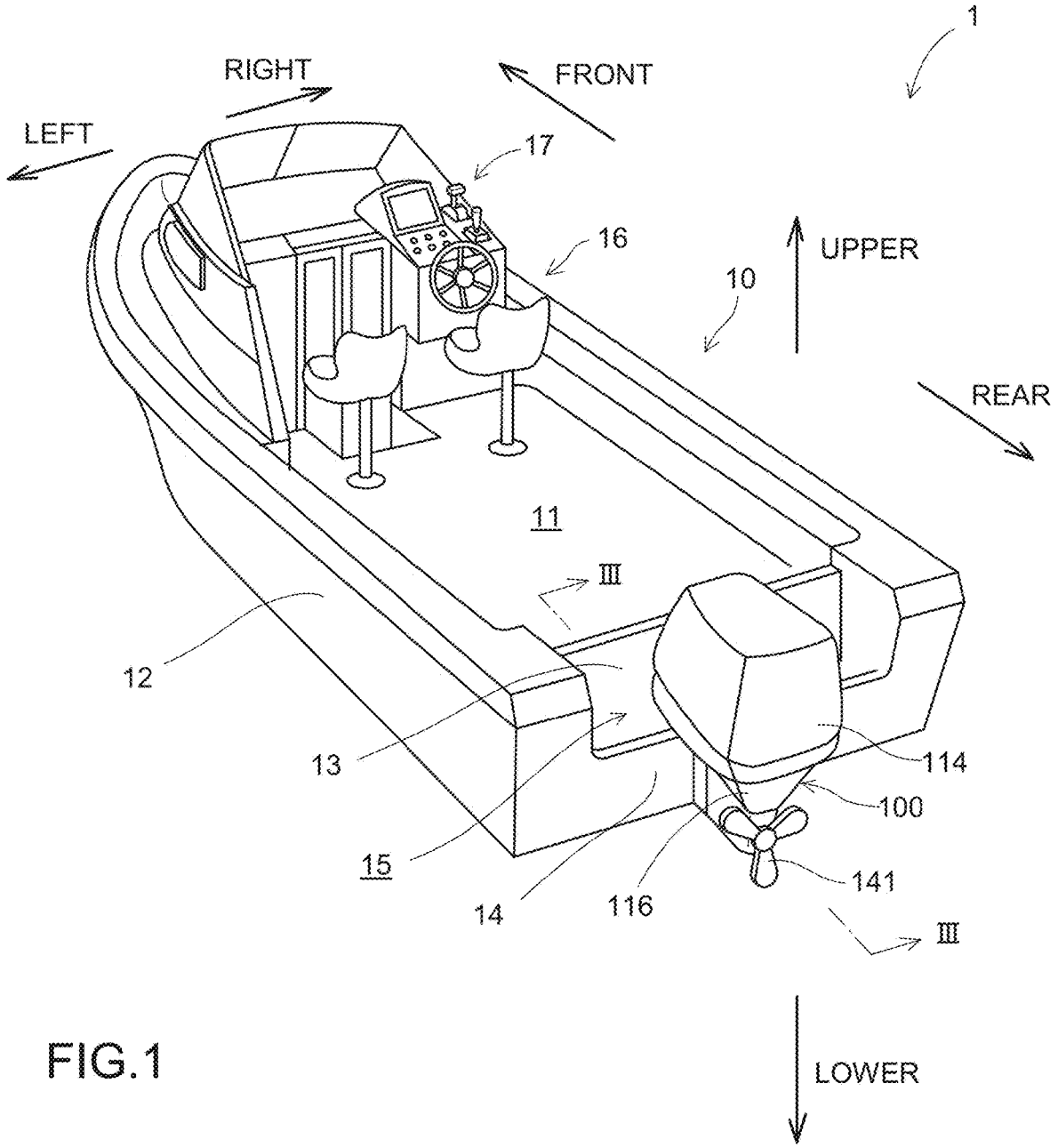
FIG. 1 is a perspective view schematically illustrating a configuration of a boat according to a first preferred embodiment of the present invention.

A first preferred embodiment of the present invention will be described with reference to FIGS. 1 to 4. A boat 1 according to the first preferred embodiment includes a hull 10 and an outboard motor 100, as shown in FIG. 1. FIG. 1 and the other figures to follow show arrows representing each direction with respect to the position of the boat 1. More specifically, each drawing shows arrows representing front (FRONT), rear (REAR), left (LEFT), right (RIGHT), upper (UPPER), and lower (LOWER) directions. The front-rear, left-right, and upper-lower (vertical) directions are orthogonal to each other.

The hull 10 is a portion of the boat 1 for occupants to ride. As shown in FIG. 1, the hull 10 includes a hull body 12 including a living space 11, a pilot seat 16 installed in the living space 11, and an operating device 17 installed near the pilot seat 16. The operating device 17 is used to maneuver the boat and includes, e.g., a steering wheel, a shift throttle lever, a joystick, a monitor, and an input device. The hull 10 also includes a partition wall 13 that partitions the rear end of the living space 11 and a transom 14 positioned at the rear end of the hull 10. In the front-rear direction, there is a space 15 between the transom 14 and the partition wall 13.

The outboard motor 100 generates thrust to propel the boat 1. The outboard motor 100 in the present preferred embodiment is an electric outboard motor driven by an electric motor 120 (an example of a drive unit). The outboard motor 100 in the reference attitude will be described below unless otherwise specified. The reference attitude is the attitude of the outboard motor 100 when the boat 1 is cruising (attitude shown in FIG. 1), in which the rotation axis Ad of the drive shaft 130 (described below) extends in the upper-lower direction and the rotation axis Apr of the propeller shaft 140 extends in the front-rear direction. The front-rear direction, the left-right direction, and the upper-lower direction are defined based on the outboard motor 100 in the reference attitude.

As shown in FIG. 1, the outboard motor 100 is attached to the transom 14 located at the rear (stern) of the hull 10. The outboard motor 100 includes an outboard motor main body 110 and a suspension device 150.

Figure 2:
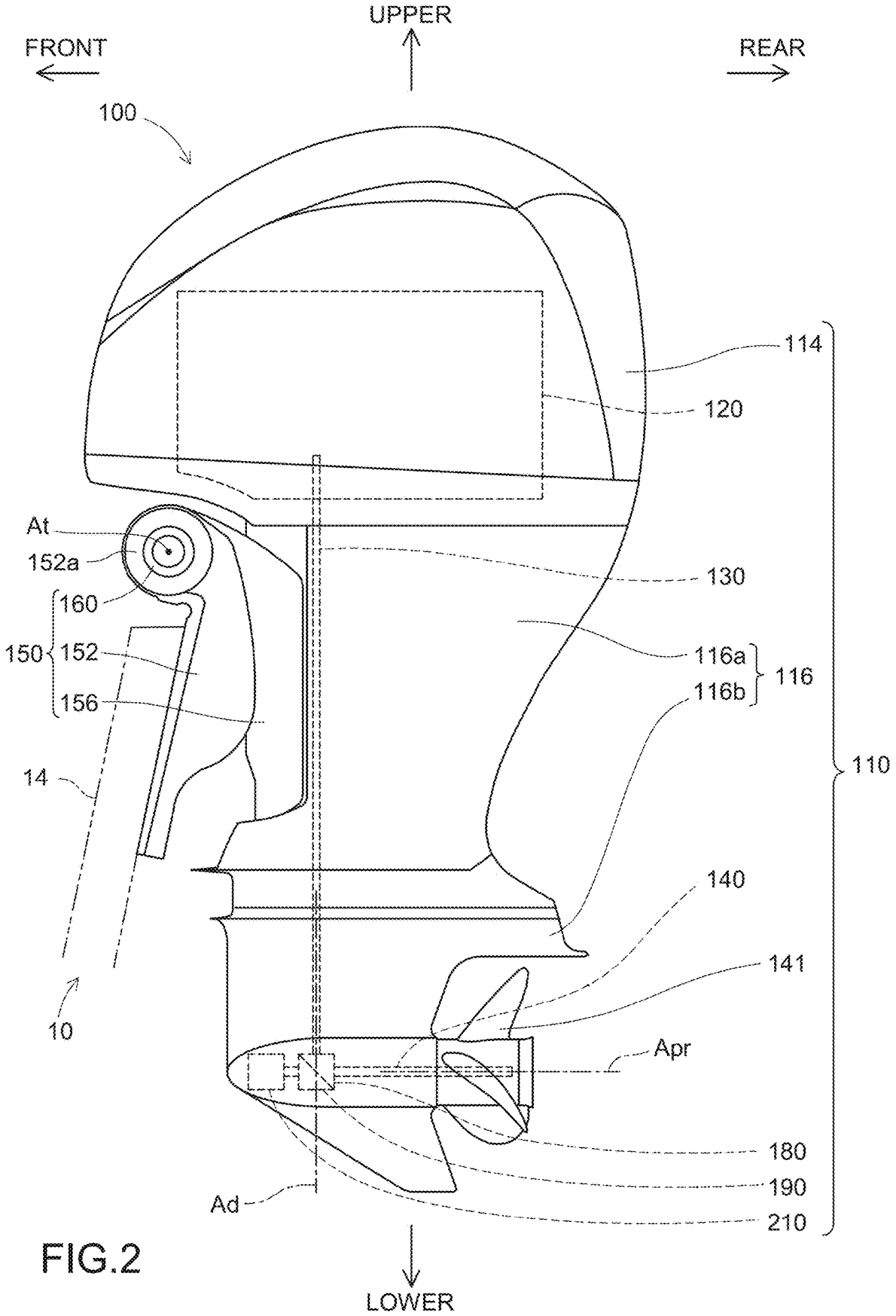
FIG. 2 is a side view schematically illustrating a configuration of an outboard motor according to the first preferred embodiment of the present invention.
Figure 3:
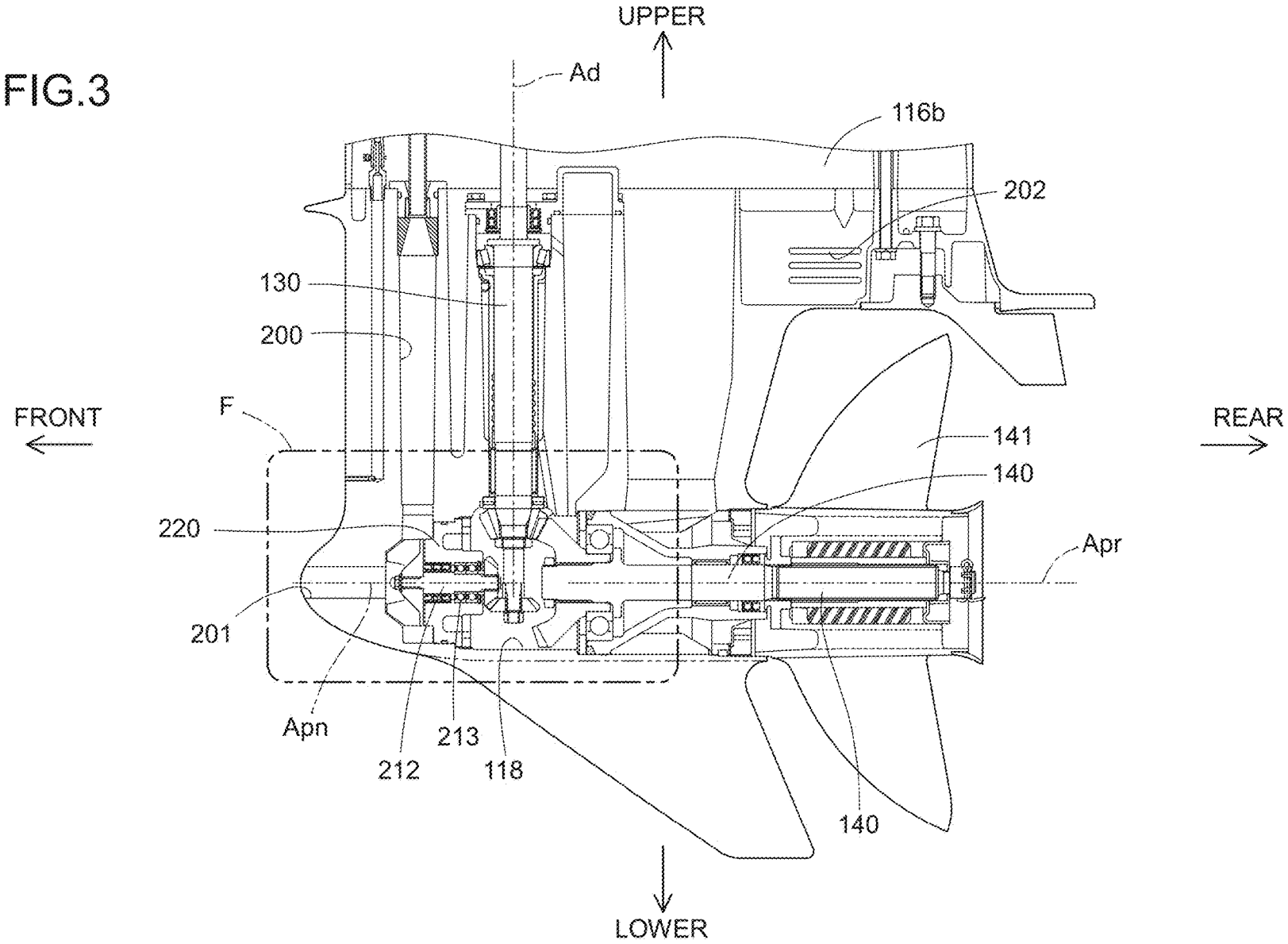
FIG. 3 is a partially enlarged cross-sectional view of the outboard motor according to the first preferred embodiment of the present invention, showing a partially enlarged cross-section cut at the position indicated by line III-III in FIG. 1.

As shown in FIGS. 2 and 3, the outboard motor main body 110 includes a cowl 114, a casing 116, an electric motor 120, a drive shaft 130, a propeller 141, a propeller shaft 140, a cooling water flow path 200, a water pump 210, a first gear mechanism 180, and a second gear mechanism 190.

As shown in FIG. 2, the cowl 114 is a housing located on top of the outboard motor main body 110. The casing 116 includes an upper case **116*a* and a lower case 116*b*, as shown in FIG. 2. The upper case 116*a* is a housing located below the cowl 114. The lower case 116*b* is a housing located below the upper case 116*a***.

The lower case 116 includes a gear chamber 118 that stores oil therein and houses the first gear mechanism 180 and the second gear mechanism 190, as shown in FIG. 3.

The electric motor 120 is driven by electric power supplied from a battery (power source). The electric motor 120 includes a rotor including a permanent magnet, a stator including a coil to which the battery power is supplied, and a motor housing that houses the rotor and stator. The electric motor 120 is located inside the cowl 114. The battery may be located inside the cowl 114 or inside the hull 10.

The drive shaft 130 is a rod-shaped member extending downward from the electric motor 120 and housed within the casing 116, as shown in FIG. 2. The drive shaft 130 is arranged in an attitude in which its rotation axis Ad extends in the upper-lower direction.

Figure 4:
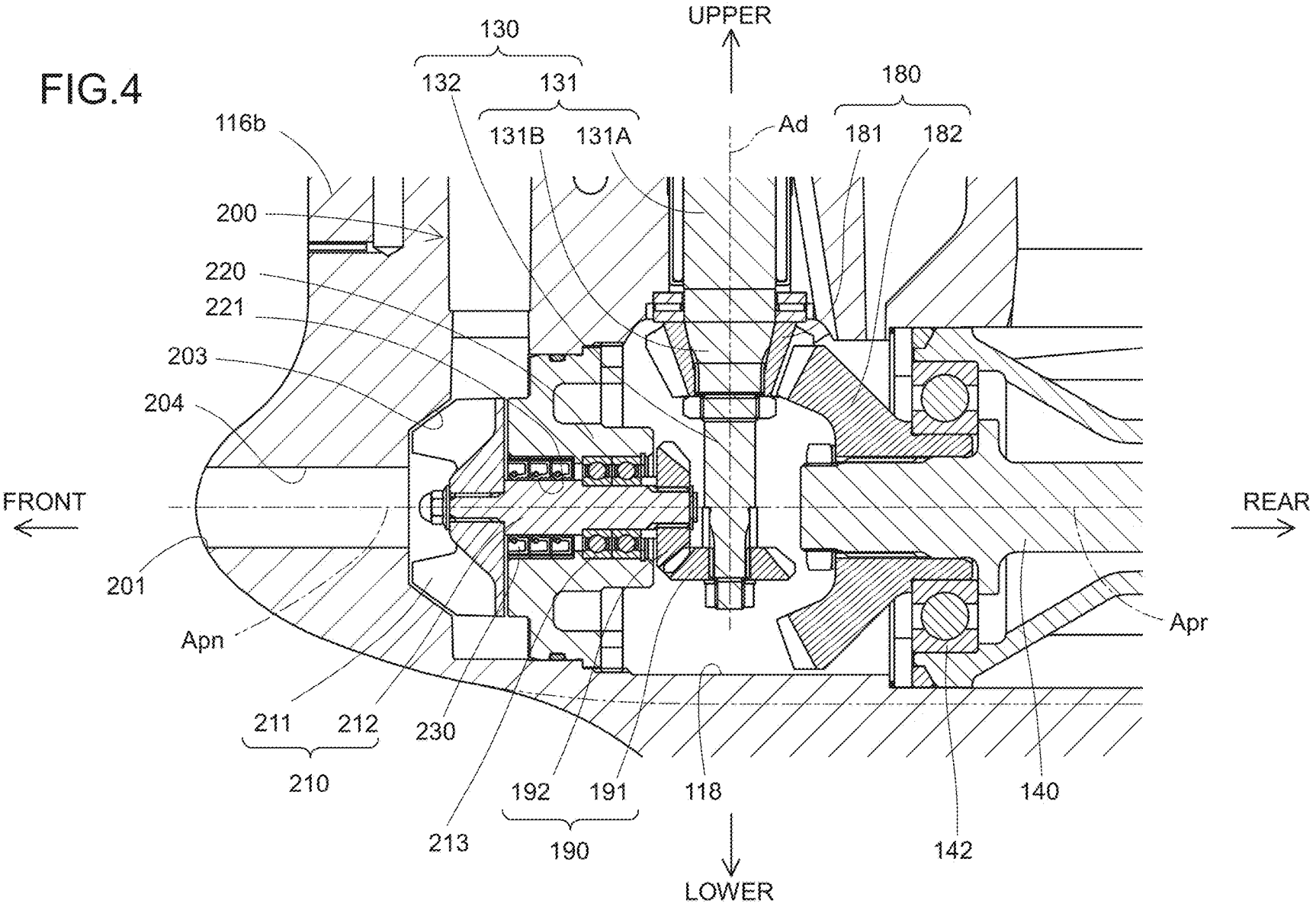
FIG. 4 is an enlarged cross-sectional view of the portion indicated by frame F in FIG. 3.

As shown in FIG. 4, the drive shaft 130 has a rod-shaped main shaft 131 and an extension shaft 132 extending from the tip of the main shaft 131 opposite to the electric motor 120 (lower end in FIG. 4). The main shaft 131 includes a constant-diameter shaft 131A extending from the electric motor 120, which is a round rod of constant thickness, and a reduced-diameter shaft 131B connecting the constant-diameter shaft 131A and the extension shaft 132. The extension shaft 132 extends coaxially with the main shaft 131 and has a round rod shape with a smaller diameter than the constant-diameter shaft 131A. The constant-diameter shaft 131A, the reduced-diameter shaft 131B, and the extension shaft 132 are arranged coaxially.

The drive shaft 130 rotates around the rotation axis Ad by the rotational driving force of the electric motor 120. Since the electric motor 120 can rotate in both forward and reverse directions, the drive shaft 130 can also rotate around the rotation axis line Ad in both the forward direction to move the boat 1 forward and the reverse direction to move the boat 1 backward, which is opposite to the forward direction, according to the rotational driving direction of the electric motor 120.

The propeller 141 is a rotating body including a plurality of blades. The propeller 141 generates thrust by rotation.

The propeller shaft 140 is a rod-shaped member and extends in the front-rear direction inside the lower case 116*b*, as shown in FIGS. 2, 3, and 4. The propeller shaft 140 is rotatably supported by the lower case 116*b* via a bearing 142. The rear end of the propeller shaft 140 protrudes rearwardly from the lower case 116*b*, and the propeller 141 is attached to this rear end. As the propeller shaft 140 rotates around the rotation axis Apr, the propeller 141 also rotates.

The cooling water flow path 200 is located inside the outboard motor main body 110. The cooling water flow path 200 is a channel through which cooling water (seawater, lake water, and river water, among others) taken from outside the outboard motor 100 flows. The cooling water flow path 200 includes an intake port 201 that opens on the outer surface of the lower case 116*b* to take cooling water into the interior and a drain port 202 that also opens on the outer surface of the lower case 116*b* to discharge cooling water to the exterior. The cooling water flow path 200 extends from the intake port 201 through the periphery of the electric motor 120 to the drain port 202. The intake port 201 is located below the waterline when the boat 1 is cruising, i.e., when the outboard motor 100 is in the reference attitude. In the present preferred embodiment, the intake port 201 is open at the front end of the lower case 116*b*.

As shown in FIG. 4, a portion of the cooling water flow path 200 defines a pump chamber 203. The pump chamber 203 is located in front of the gear chamber 118 in the lower case 116*b* and is separated from the gear chamber 118 by a partition 220 (an example of a partition wall). The partition 220 includes a shaft hole 221 that is connected to the pump chamber 203 and the gear chamber 118.

The water pump 210 is a non-volumetric pump having an impeller 211 and a pump shaft 212 to rotate together with the impeller 211, as shown in FIG. 4. In the present preferred embodiment, a centrifugal pump is exemplified as the water pump 210.

The impeller 211 is a rotating body including a plurality of blades and is located inside the pump chamber 203. The pump shaft 212 is a rod-shaped member and extends in a front-rear direction. The pump shaft 212 is inserted into the shaft hole 221 and is supported by the partition 220 in a rotatable manner via a bearing 213. The rotation axis Apn of the pump shaft 212 coincides with the rotation axis Apr of the propeller shaft 140. The impeller 211 is attached to the front end of the pump shaft 212. In other words, the water pump 210 (specifically, the pump shaft 212 and the impeller 211) is located on the rotation axis Apr of the propeller shaft 140. As the pump shaft 212 rotates around the rotation axis Apn, the impeller 211 also rotates.

The front end of the pump shaft 212 and the impeller 211 are located inside the pump chamber 203. The rear end of the pump shaft 212 is located inside the gear chamber 118.

The portion of the cooling water flow path 200 from the intake port 201 to the water pump 210, i.e., the portion located between the intake port 201 and the pump chamber 203 (inlet channel 204), is located in front of the water pump 210 and extends along the rotation axis Apn of the pump shaft 212, as shown in FIG. 4.

Inside the shaft hole 221, as shown in FIG. 4, a plurality of seals 230 are arranged on the outer surface of the pump shaft 212 to fill the gap between the inner surface of the shaft hole 221 and the pump shaft 212. Each seal 230 is circular in shape, is made of a material such as rubber having rubber elasticity, and encircles the pump shaft 212 all the way around. The plurality of seals 230 are arranged in line along the rotation axis Apn of the pump shaft 212. These seals 230 prevent cooling water flowing into the pump chamber 203 from entering the gear chamber 118 through the gap between the inner circumferential surface of the shaft hole 221 and the pump shaft 212.

The first gear mechanism 180 transmits the rotation of the drive shaft 130 to the propeller shaft 140, and the second gear mechanism 190 transmits the rotation of the drive shaft 130 to the pump shaft 212. The first gear mechanism 180 and the second gear mechanism 190 have different gear ratios.

The first gear mechanism 180 includes a first gear 181 and a second gear 182, as shown in FIG. 4. The first gear 181 is coaxially mounted to the main shaft 131 of the drive shaft 130 (more specifically, the reduced-diameter shaft 131B) and rotates together with the drive shaft 130. The second gear 182 is coaxially mounted to the propeller shaft 140 and rotates together with the propeller shaft 140. The second gear 182 meshes with the first gear 181. The first gear 181 and the second gear 182 are, e.g., bevel gears.

The second gear mechanism 190 includes a third gear 191 and a fourth gear 192, as shown in FIG. 4. The third gear 191 is a gear that is coaxially mounted to the extension shaft 132 of the drive shaft 130 and rotates together with the drive shaft 130. The third gear 191 has a smaller outer diameter than the first gear 181 and is located farther from the electric motor 120 than the first gear 181. The fourth gear 192 is coaxially mounted to the pump shaft 212 and rotates together with the pump shaft 212. The fourth gear 192 meshes with the third gear 191. The third gear 191 and the fourth gear 192 are, e.g., bevel gears.

With respect to the two gears 181 and 191 mounted on the drive shaft 130, the force applied to the first gear 181, which is used to rotate the propeller 141 to propel the boat 1, is greater than the force applied to the third gear 191, which is used to drive the water pump 210. In the present preferred embodiment, the first gear 181, which receives a relatively large force, is mounted closer to the electric motor 120 than the third gear 191 with respect to the drive shaft 130. This stabilizes the transmission of rotation from the drive shaft 130 to the propeller shaft 140 by the first gear mechanism 180 compared to the case where the first gear 181 is mounted farther from the electric motor 120 than the third gear 191. In addition, because the third gear 191, which receives a relatively small force, is mounted on the extension shaft 132, which is thinner than the main shaft 131 on which the first gear 181 is mounted, the third gear 191 and its surrounding configuration is more compact, and the outboard motor 100 is prevented from becoming larger.

The first gear mechanism 180 and the second gear mechanism 190 are located inside the gear chamber 118. The four gears 181, 182, 191, and 192 are lubricated by oil provided inside the gear chamber 118.

As described above, the drive shaft 130, which is rotationally driven by the electric motor 120, is able to rotate in both the forward and reverse directions, thus eliminating the need for a clutch mechanism, such as a dog clutch, to switch the direction of rotation of the propeller shaft 140. Therefore, there is a relatively large space around the propeller shaft 140 in the lower case 116*b*, and this space is used to accommodate the water pump 210 and the gear mechanisms 180 and 190. This optimizes the arrangement of the components necessary to transport cooling water while avoiding an increase in the size of the outboard motor 100. The space can also accommodate the length of the pump shaft 212 necessary to position the multiple seals 230, such that the cooling water is prevented from entering the gear chamber 118.

The suspension device 150 suspends the outboard motor main body 110 on the hull 10. The suspension device 150 includes a pair of left and right clamp brackets 152, a tilt shaft 160, and a connection bracket 156, as shown in FIG. 2.

The pair of left and right clamp brackets 152 are disposed behind the hull 10 in a state separated from each other in the left-right direction and are fixed to the transom 14 of the hull 10 by using, e.g., bolts. Each clamp bracket 152 includes a cylindrical supporting portion 152*a* provided with a through-hole extending in the left-right direction.

The tilt shaft 160 is a rod-shaped member. The tilt shaft 160 is rotatably supported in the through-hole of the supporting portion 152*a* of the clamp bracket 152. The tilt axis At, which is the center line of the tilt shaft 160, defines an axis in the horizontal direction (left-right direction) during the tilting action of the outboard motor 100.

The connection bracket 156 is disposed so as to be sandwiched between the pair of clamp brackets 152 and is supported by the supporting portion 152*a* of the clamp bracket 152 via the tilt shaft 160 in such a manner that the connection bracket 156 can rotate around the tilt axis At. The connection bracket 156 is fixed to the outboard motor main body 110. The connection bracket 156 is rotationally driven around the tilt axis At with respect to the clamp bracket 152 by a tilt device (not shown) including an actuator such as, e.g., a hydraulic cylinder.

When the connection bracket 156 rotates about the tilt axis At with respect to the clamp bracket 152, the outboard motor main body 110 fixed to the connection bracket 156 also rotates about the tilt axis At. This achieves the tilting action of rotating the outboard motor main body 110 in the upper-lower direction with respect to the hull 10. By this tilting action, the outboard motor 100 can change the angle around the tilt axis At of the outboard motor main body 110 in the range from the tilt-down state in which the propeller 141 is located under the waterline (the state in which the outboard motor 100 is in the reference attitude: the state shown in FIG. 1) to the tilt-up state in which the propeller 141 is above the waterline. Trimming action to adjust the attitude of the boat 1 during cruising can also be performed by adjusting the angle around the tilt axis At of the outboard motor main body 110.

When the boat 1 is cruising, the outboard motor 100 is placed in the tilt-down state, and the lower case 116*b* and the propeller 141 are positioned below the waterline. The intake port 201, inlet channel 204, pump chamber 203, and water pump 210 located inside the lower case 116*b* are also below the waterline, and cooling water flows into the pump chamber 203 from outside through the intake port 201 and inlet channel 204.

When the electric motor 120 is driven, the drive shaft 130 rotates around the rotation axis Ad by the rotational driving force of the electric motor 120.

The rotation of the drive shaft 130 is transmitted to the propeller shaft 140 via the first gear mechanism 180. When the first gear mechanism 180 transmits the forward rotation of the drive shaft 130 to the propeller shaft 140, the propeller 141 rotating together with the propeller shaft 140 generates thrust in the forward direction. When the first gear mechanism 180 transmits the reverse rotation of the drive shaft 130 to the propeller shaft 140, the propeller 141 rotating together with the propeller shaft 140 generates thrust in the rearward direction.

The rotation of the drive shaft 130 is transmitted to the pump shaft 212 via the second gear mechanism 190, and the impeller 211 rotates together with the pump shaft 212. Cooling water taken in from the intake port 201 is pumped through the cooling water flow path 200 by centrifugal force generated by the rotation of the impeller 211, and is supplied around the electric motor 120 to cool the electric motor 120. In addition to the electric motor 120, the cooling water may also cool the battery, inverter, and reduction gears, among others, located inside the outboard motor main body 110. After being used for cooling, the cooling water is discharged to the outside through the drain port 202.

The intake port 201 and the inlet channel 204 are located on the rotation axis Apn of the pump shaft 212 and in front (bow side) of the water pump 210 so that when the boat 1 moves forward, the cooling water flows through the intake port 201 and the inlet channel 204 from the front to the impeller 211. This allows the cooling water to be pumped efficiently, especially when the boat 1 is moving forward.

As the propeller shaft 140 rotates in both the forward and reverse directions, the pump shaft 212 also rotates around the rotation axis Apn in both the direction of rotation associated with the forward rotation of the propeller shaft 140 and the direction of rotation associated with the reverse rotation of the propeller shaft 140. The water pump 210, which is a non-volumetric pump with no restriction on the direction of rotation, operates normally no matter which direction the propeller shaft 140 rotates.

As described above, the outboard motor 100 is provided with the second gear mechanism 190 to pump cooling water separate from the first gear mechanism 180 to rotate the propeller 141. This configuration provides greater flexibility in setting the rotational speed of the impeller 211 attached to the pump shaft 212, thus enabling efficient transport of cooling water.

The gear ratio of the first gear mechanism 180 and the second gear mechanism 190 are different from each other. This configuration makes it easier to set the ratio of the first gear mechanism 180 to an appropriate ratio to propel the boat 1 and to set the ratio of the second gear mechanism 190 to an appropriate ratio to transport the cooling water.

Furthermore, the first gear mechanism 180 includes the first gear 181 to rotate together with the drive shaft 130 and the second gear 182 to mesh with the first gear 181 and rotates together with the propeller shaft 140, wherein the second gear mechanism 190 includes the third gear 191 to rotate together with the drive shaft 130 and the fourth gear 192 to mesh with the third gear 191 and rotates together with the pump shaft 212. In other words, the first gear mechanism 180 and the second gear mechanism 190 do not share a single gear attached to the drive shaft 130 but rather transmit rotation through different gears (the first gear 181 and the third gear 191). This configuration provides greater flexibility in setting the rotational speed of the impeller 211 compared to the case where they share a single gear attached to the drive shaft 130, allowing for even more efficient cooling water transport.

As described above, the outboard motor 100 of the present preferred embodiment includes the electric motor 120, the drive shaft 130 to be rotationally driven by the electric motor 120, the propeller 141, the propeller shaft 140 to rotate together with the propeller 141, the cooling water flow path 200 through which cooling water flows, the water pump 210 including the impeller 211 and the pump shaft 212 to rotate together with the impeller 211 to pump the cooling water into the cooling water flow path 200, the first gear mechanism 180 to transmit rotation of the drive shaft 130 to the propeller shaft 140, and the second gear mechanism 190 to transmit rotation of the drive shaft 130 to the pump shaft 212. The first gear mechanism 180 includes the first gear 181 to rotate together with the drive shaft 130 and the second gear 182 to mesh with the first gear 181 and rotate together with the propeller shaft 140, wherein the second gear mechanism 190 includes the third gear 191 that rotates together with the drive shaft 130 and is, different from the first gear 181, to rotate together with the drive shaft 130, and the fourth gear 192 to mesh with the third gear 191 and rotate together with the pump shaft 212.

According to the above configuration, the second gear mechanism 190 to transmit the rotation of the drive shaft 130 to the pump shaft 212 is provided separately from the first gear mechanism 180 to transmit the rotation of the drive shaft 130 to the propeller shaft 140. This configuration allows for greater flexibility in setting the speed of rotation of the impeller 211 attached to the pump shaft 212, thus enabling efficient cooling water transport.

In addition, the drive shaft 130 is able to rotate in both the forward direction and the reverse direction, which is opposite to the forward direction, and the water pump 210 is a non-volumetric pump.

The drive shaft 130, is able to rotate in both the forward and reverse directions, eliminates the need for a clutch mechanism such as a dog clutch, thus providing a relatively large space around the propeller shaft 140. This space can be used to accommodate the water pump 210 and the gear mechanisms 180 and 190, thus avoiding an increase in the size of the outboard motor 100 and optimizing the arrangement of the components necessary to transport the cooling water. In addition, since the non-volumetric water pump 210 has no restrictions on the direction of rotation, it is suitable as a pump connected to the drive shaft 130 is able to rotate in both forward and reverse directions.

The gear ratio of the first gear mechanism 180 and the gear ratio of the second gear mechanism 190 are different from each other. Such a configuration makes it easier to set the gear ratio of the first gear mechanism 180 to an appropriate gear ratio to propel the boat 1 and to set the gear ratio of the second gear mechanism 190 to an appropriate gear ratio to transport the cooling water.

The first gear 181 is located closer to the electric motor 120 than the third gear 191. The first gear 181, which is used to rotate the propeller 141 that propels the boat 1, receives a greater force than the third gear 191, which is used to drive the water pump 210. Locating the first gear 181 relatively close to the drive unit stabilizes the transmission of rotation through the first gear mechanism 180.

The drive shaft 130 includes the main shaft 131 and the extension shaft 132 extending from the tip of the main shaft 131 opposite to the electric motor 120 and having a smaller outer diameter than the main shaft 131, wherein the first gear 181 is located on the main shaft 131 and the third gear 191 is located on the extension shaft 132.

The third gear 191, which is used to drive the water pump 210, receives less force than the first gear 181, which is used to rotate the propeller 141 to propel the boat 1. By locating the third gear 191 on the extension shaft 132, which is narrower than the main shaft 131 where the first gear 181 is located, the third gear 191 and its surrounding configuration is more compact, and the outboard motor 100 is prevented from becoming larger.

In addition, the water pump 210 is located on the rotation axis Apr of the propeller shaft 140. This configuration allows the water pump 210 to be positioned without protruding sideways, thus avoiding a reduction in the propulsive force of the hull 10.

The cooling water flow path 200 includes an intake port 201 to take in cooling water from the outside, and the inlet channel 204 of the cooling water flow path 200 from the intake port 201 to the water pump 210 is located in front of the water pump 210 and extends along the rotation axis Apn of the pump shaft 212. In this configuration, cooling water taken in from the outside flows in from the front to the impeller 211 attached to the pump shaft 212, thus enabling efficient pumping of the cooling water.

The outboard motor 100 further includes the lower case **116*b* including a gear chamber 118 that houses the first gear mechanism 180, the second gear mechanism 190, and lubricating oil, and a pump chamber 203 that houses the water pump 210, wherein the lower case 116*b* includes the partition 220 dividing the gear chamber 118 from the pump chamber 203 and including the shaft hole 221 through which the pump shaft 212 is inserted, and the plurality of seals 230 are arranged inside the shaft hole 221 on the outer surface of the pump shaft 212 to fill the gap between the inner surface of the shaft hole 221 and the pump shaft 212 in line along the rotation axis Apn of the pump shaft 212**.

When the shaft hole 221 through which the pump shaft 212 is inserted is located in the partition 220 dividing the gear chamber 118 and the pump chamber 203 as described above, it is important to prevent water from entering the gear chamber 118 from the pump chamber 203 through the shaft hole 221. By arranging the plurality of seals 230 in line along the rotation axis Apn of the pump shaft 212, it is possible to reliably prevent water from entering the gear chamber 118.

(1) In the above preferred embodiments, as an example, the electric outboard motor 100 is driven by the electric motor 120, but the drive unit of the outboard motor does not have to be an electric motor and may be, e.g., an internal combustion engine.

(2) In the above preferred embodiments, the drive shaft 130 is rotatable in both the forward and reverse directions according to the rotational drive direction of the electric motor 120, but the outboard motor may include an internal combustion engine as a drive unit and a shift mechanism to switch the rotational direction of the drive shaft.

(3) In the above preferred embodiments, the drive shaft 130 includes a main shaft 131 and an extension shaft 132, but the drive shaft configuration is not limited to the above preferred embodiments, for example, it may have an equal thickness over its entire length.

(4) In the above preferred embodiments, the first gear 181 is located closer to the electric motor 120 than the third gear 191, but the positional relationship between the first gear and the third gear is not limited to the above preferred embodiments. For example, the third gear may be positioned closer to the drive unit than the first gear.

(5) In the above preferred embodiments, the third gear 191 has a smaller outer diameter than the first gear 181, but the size relationship between the first gear and the second gear is freely selectable, e.g., the first gear and the third gear may have the same or approximately the same outer diameter.

(6) In the above preferred embodiments, the rotation axis Apn of the pump shaft 212 is coincident with the rotation axis Apr of the propeller shaft 140, but the position of the pump shaft is not limited to the above preferred embodiments, e.g., the rotational axis Apn of the pump shaft 212 may be shifted with respect to the rotational axis Apr of the propeller shaft 140.

(7) In the above preferred embodiments, a plurality of seals 230 are attached to the pump shaft 212, but the number of seals is freely selectable and may be, e.g., only one.

Figure 5:
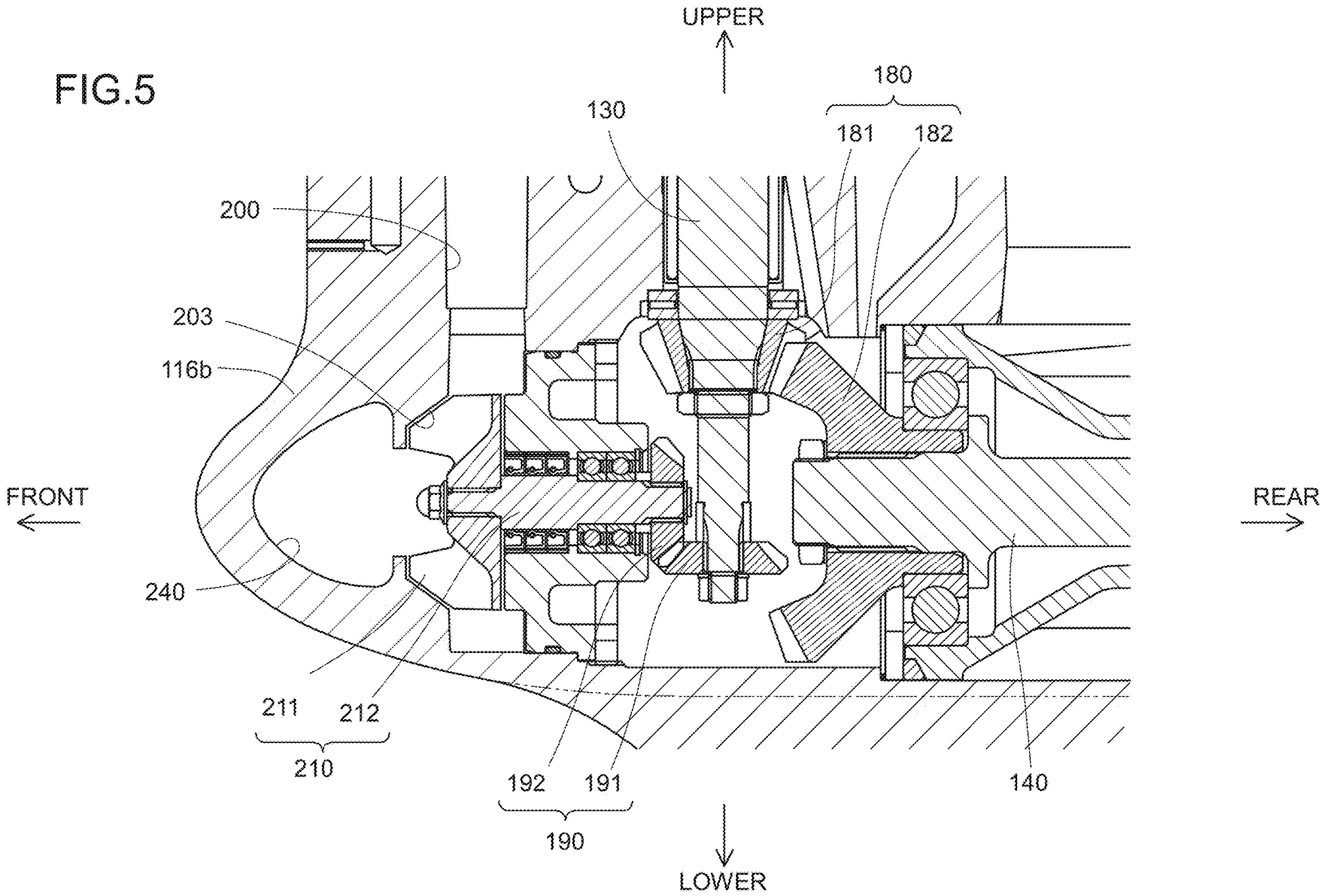
FIG. 5 is a partially enlarged cross-sectional view of an outboard motor according to another preferred embodiment of the present invention.

(8) In the above preferred embodiments, the inlet channel 204 from the intake port 201 to the water pump 210 of the cooling water flow path 200 extends along the rotation axis Apn of the pump shaft 212, but the arrangement of the intake port and the inlet channel is freely selectable, e.g., as shown in FIG. 5, the intake port 240 may open on the side of the lower case 116*b*.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor to be mounted on a hull, the outboard motor comprising:

a drive unit;

a drive shaft to be rotationally driven by the drive unit;

a propeller;

a propeller shaft to rotate together with the propeller;

a cooling water flow path through which cooling water flows;

a water pump including an impeller and a pump shaft to rotate together with the impeller to pump the cooling water into the cooling water flow path;

a first gear mechanism to transmit rotation of the drive shaft to the propeller shaft; and a second gear mechanism to transmit rotation of the drive shaft to the pump shaft; wherein the first gear mechanism includes:

a first gear to rotate together with the drive shaft; and a second gear to mesh with the first gear and rotate together with the propeller shaft; and the second gear mechanism includes:

a third gear, different from the first gear, to rotate together with the drive shaft; and a fourth gear to mesh with the third gear and rotate together with the pump shaft.

2. The outboard motor according to claim 1, wherein the drive shaft is rotatable in both a forward direction and a reverse direction opposite to the forward direction; and the water pump is a non-volumetric pump.

3. The outboard motor according to claim 2, wherein the drive unit includes an electric motor to be driven by electricity supplied from a power source.

4. The outboard motor according to claim 2, wherein the water pump is a centrifugal pump.

5. The outboard motor according to claim 3, wherein the water pump is a centrifugal pump.

6. The outboard motor according to claim 1, wherein the first gear mechanism and the second gear mechanism have different gear ratios.

7. The outboard motor according to claim 2, wherein the first gear mechanism and the second gear mechanism have different gear ratios.

8. The outboard motor according to claim 1, wherein the first gear is located closer to the drive unit than the third gear.

9. The outboard motor according to claim 2, wherein the first gear is located closer to the drive unit than the third gear.

10. The outboard motor according to claim 6, wherein the first gear is located closer to the drive unit than the third gear.

11. The outboard motor according to claim 8, wherein the drive shaft includes a main shaft and an extension shaft extending from a tip of the main shaft opposite to the drive unit and having a smaller outer diameter than the main shaft; and the first gear is located on the main shaft, and the third gear is located on the extension shaft.

12. The outboard motor according to claim 9, wherein the drive shaft includes a main shaft and an extension shaft extending from a tip of the main shaft opposite to the drive unit and having a smaller outer diameter than the main shaft; and the first gear is located on the main shaft, and the third gear is located on the extension shaft.

13. The outboard motor according to claim 10, wherein the drive shaft includes a main shaft and an extension shaft extending from a tip of the main shaft opposite to the drive unit and having a smaller outer diameter than the main shaft; and the first gear is located on the main shaft, and the third gear is located on the extension shaft.

14. The outboard motor according to claim 1, wherein the water pump is located on a rotation axis of the propeller shaft.

15. The outboard motor according to claim 2, wherein the water pump is located on a rotation axis of the propeller shaft.

16. The outboard motor according to claim 1, wherein the cooling water flow path includes an intake port to take in cooling water from outside the outboard motor; and a portion of the cooling water flow path from the intake port to the water pump is in front of the water pump and extends along a rotation axis of the pump shaft.

17. The outboard motor according to claim 2, wherein the cooling water flow path includes an intake port to take in cooling water from outside the outboard motor; and a portion of the cooling water flow path from the intake port to the water pump is in front of the water pump and extends along a rotation axis of the pump shaft.

18. The outboard motor according to claim 1, further comprising:

a lower case including a gear chamber housing the first gear mechanism, the second gear mechanism, and lubricating oil, and a pump chamber housing the water pump; wherein the lower case includes a partition wall that divides the gear chamber and the pump chamber and includes a shaft hole through which the pump shaft is inserted; and a plurality of seals are inside the shaft hole on an outer surface of the pump shaft to fill a gap between an inner surface of the shaft hole and the pump shaft and arranged in line along a rotation axis of the pump shaft.

19. The outboard motor according to claim 2, further comprising:

a lower case including a gear chamber housing the first gear mechanism, the second gear mechanism, and lubricating oil, and a pump chamber housing the water pump; wherein the lower case includes a partition wall that divides the gear chamber and the pump chamber and includes a shaft hole through which the pump shaft is inserted; and a plurality of seals are inside the shaft hole on an outer surface of the pump shaft to fill a gap between an inner surface of the shaft hole and the pump shaft and arranged in line along a rotation axis of the pump shaft.

* * * * *